United States Patent [19]

Barr

[11] 4,158,989

[45] Jun. 26, 1979

[54] CONSTANT FLOW CONTAINER MANUFACTURING DEVICE

[76] Inventor: Cloyd B. Barr, R.D. #1, Box 698, Altoona, Pa. 16601

[21] Appl. No.: 866,518

[22] Filed: Jan. 3, 1978

[51] Int. Cl.[2] ..... B31B 3/74; B31B 17/14; B31C 7/02

[52] U.S. Cl. ..... 93/44; 93/39.3; 93/94 FC

[58] Field of Search ..... 93/39.1 R, 39.2 R, 39.3 R, 93/36.5 R, 93 DP, 94 FC, 44, 44.1 R

[56] References Cited

U.S. PATENT DOCUMENTS

| | | | |
|---|---|---|---|
| 2,117,295 | 5/1938 | Buckingham | 93/39.3 |
| 2,746,626 | 5/1956 | Vantlander et al. | 93/36.2 X |
| 3,342,113 | 9/1967 | Baumgartner | 93/36.5 R X |

*Primary Examiner*—E. F. Desmond
*Attorney, Agent, or Firm*—Thomas E. Sterling

[57] ABSTRACT

This invention is a constant flow container manufacturing device and process which consists of a rotating die drum device containing three paper punching machines capable of punching a circular container bottom, a rotary conveyor system synchronized at the same speed as the rotating die drum device and containing a plurality of rotatable mandrels thereon, said mandrels being synchronized to pass opposite the rotating paper punching machine. Means of transferring the container bottom from the rotating paper punching device to the moving mandrels. A paper clamp, positioned on the mandrel, adapted to clamp the edge of a pre-gummed paper blank, which rotates around the mandrel as it turns, pressing the pre-gummed paper blank to form a cup-like container on the mandrel.

7 Claims, 5 Drawing Figures

CONSTANT FLOW CONTAINER MANUFACTURING DEVICE

This invention relates to container manufacturing devices, and in particular to a constant flow non indexing paper cup manufacturing machine.

The present manufacture of paper cups and the like, comprises machinery which halts or indexes the paper cup at each successive step in its manufacture. This invention relates to a constant flow container manufacturing device in which the paper cup or container is made without the necessity of halting indexing operations, and as a continuous process. This is accomplished by a rotating circular die drum containing a plurality of paper punching devices. The die drum device is positioned immediately adjacent to a rotating conveyor system containing a plurality of moving mandrels adapted to the manufacture of paper cups or containers. The moving mandrels pass the rotating die drum device in such synchronization and speed that the paper punching device cuts and presses a circular bottom disc into the moving mandrel which is directly opposite it in the process of rotation. The mandrel, now containing circular bottom disc of the container, then moves on to station II where a pre-gummed or adhesived sidewall paper blank, to be the wall of the cup or container, is delivered. A clamping device on the mandrel, clamps the paper blank. The mandrel then rotates to position the paper blank laterally upon its outer surface to form the side of a paper cup. Pre-gummed surfaces of the paper blank adhere to the circular bottom disc and are pressed against themselves to form the sidewall of a conical container. The moving mandrel now has a completed paper cup thereon and moves to a further station where it is ejected from the mandrel.

An object of this invention therefore is to produce a continuous process paper cup making machine which does not have indexing operations.

Another object of this invention is to produce a container manufacturing machine which will operate with low maintenance and less noise.

Yet another object of this invention is to produce a machine which will manufacture paper containers at high speed.

Yet another object of this invention is to produce a paper cup making machine in which stop and go indexing operations are not used.

Still another object of this invention is to produce a new continuous flow process and method for the manufacture of paper cups and the like.

These and other objects of the invention will become apparent from the below drawings and specification, in which.

Figure 1:
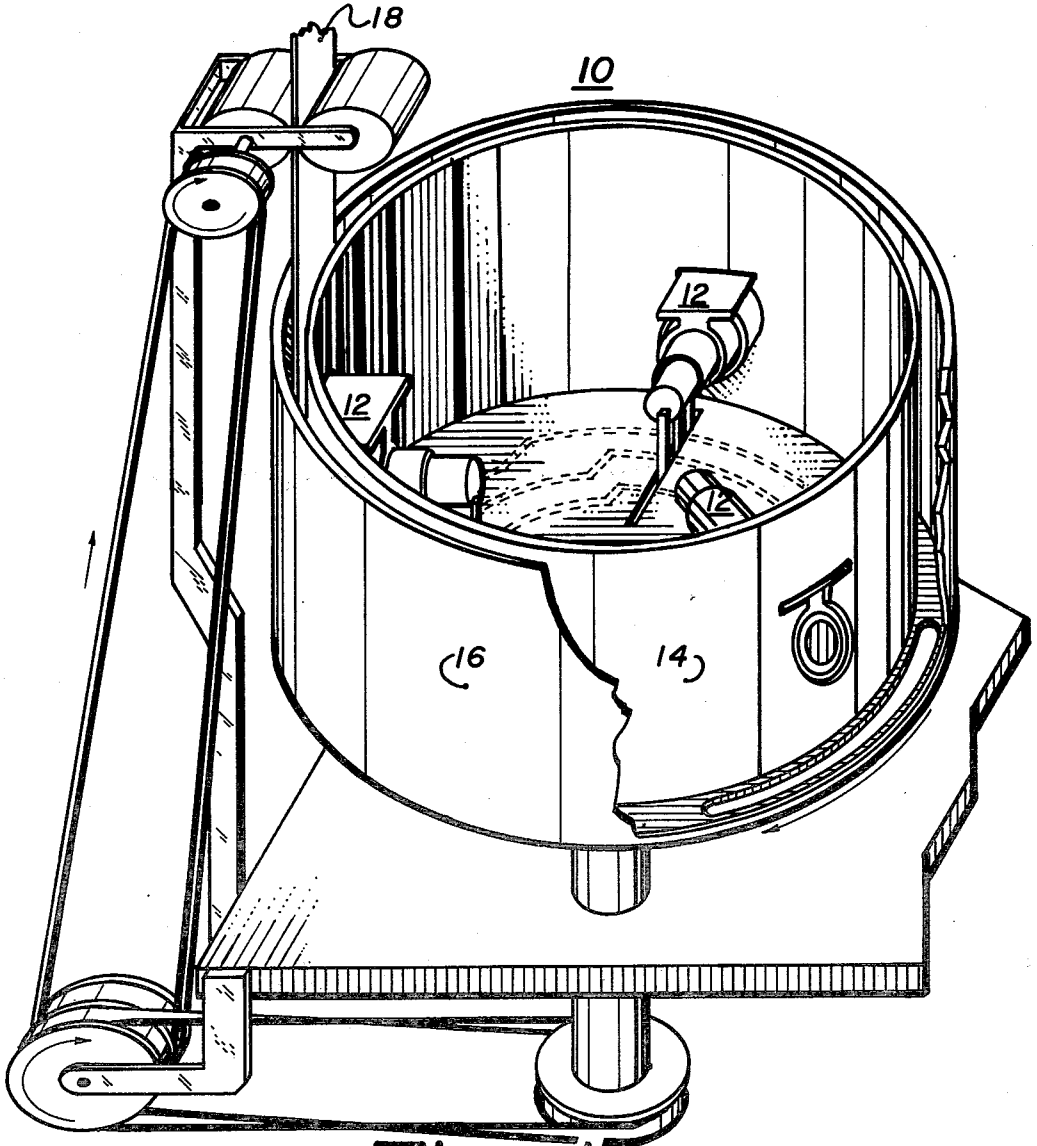
FIG. 1, is a plan view of a rotating die drum device containing three paper punching devices.

Referring now to the drawings, and in particular to FIG. 1, 10 represents a circular die drum device comprised of a circular inner wall 14 and a circular outer wall 16 with a space therebetween. Three paper punching devices 12 are equally spaced within the die drum device 10 extending through inner wall 14 and outer wall 16. Paper stock 18 extends between inner wall 14 and outer wall 16.

Figure 2:
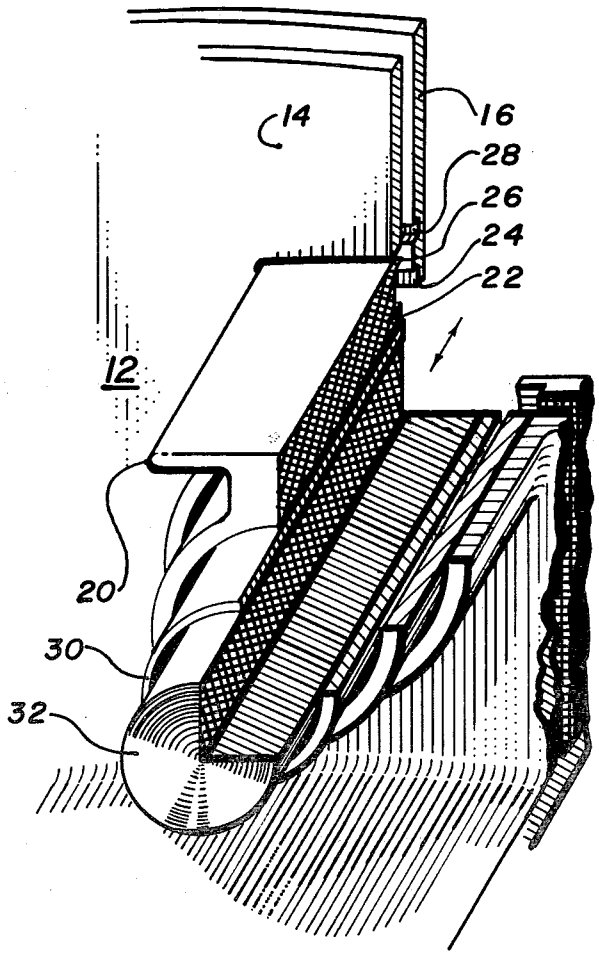
FIG. 2, is a plan view of the paper punching device of FIG. 1, partially in section.

Referring to FIG. 2, paper punching device 12 is comprised of a circular transferring tool 32 positioned in the central portion thereof surrounded by a concentric cylindrically shaped forming tool 30 which, in turn, is surrounded by a concentric cylindrically shaped paper punch carriage 20. Each of these elements may move axially with respect to one another. Paper punch carriage 20 is comprised of a flat upper portion having a forwardly positioned parting tool 26 and a male punch 22 immediately adjacent to the outer wall 16. Parting tool 26 is adapted to engage a parting groove in outer wall 16. Male punch 22 is adapted to engage female die groove 24 also positioned on the inner portion of outer wall 16. Thus, when paper punch carriage 20 moves toward outer wall 16, parting tool 26 and male punch 22 will cut paper stock 18 between inner wall 14 and outer wall 16.

Figure 3:
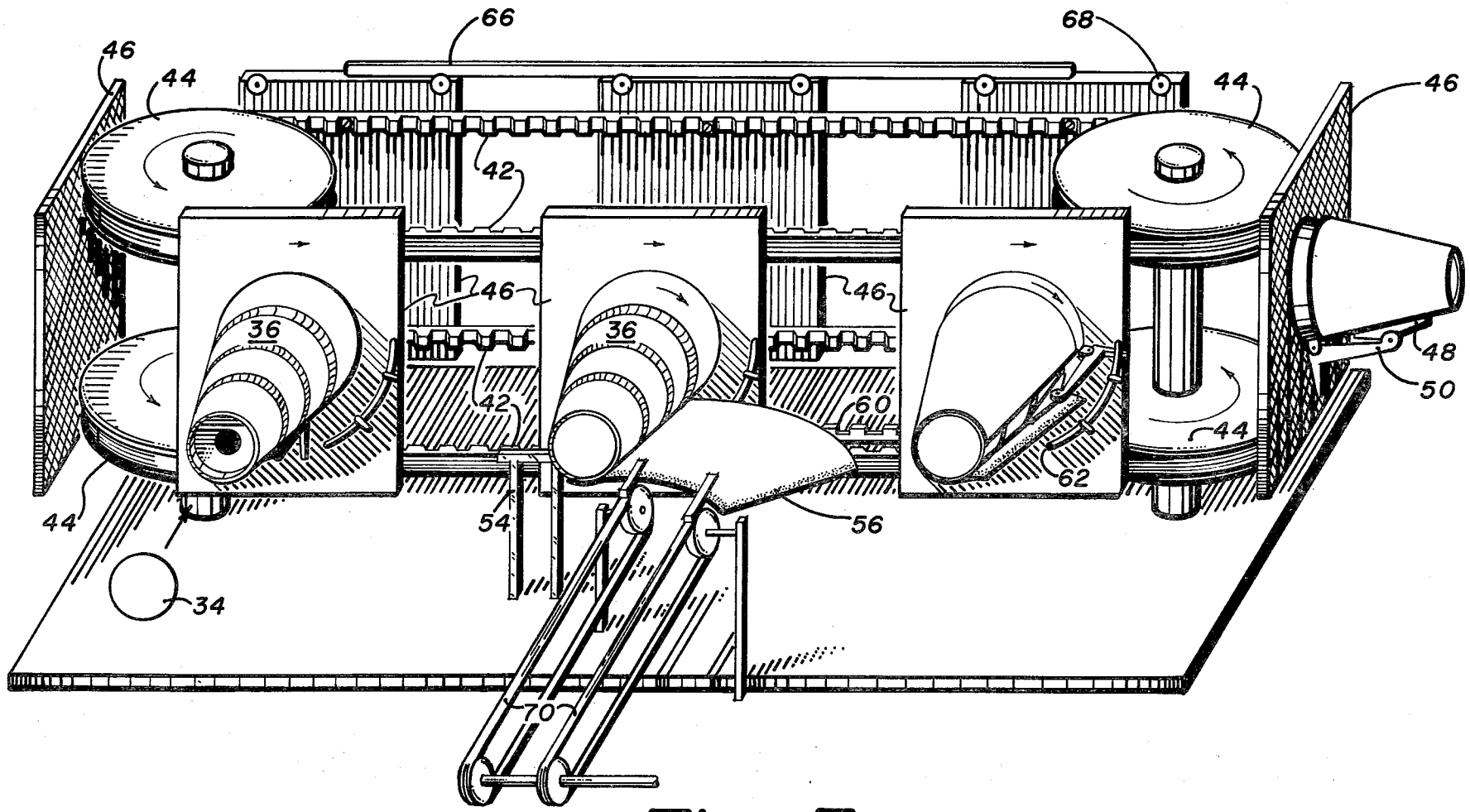
FIG. 3, is a plan view of a rotating conveyor system containing a number of moving mandrels thereon.

Referring now to FIG. 3, 40 represents a rotary conveyor system comprised of two horizontal timing belts 42 engaged by four horizontal timing pulleys 44 which are adapted to rotate counter clockwise. A number of rectangular carrier plates 46 are vertically positioned upon timing belts 42 and secured thereto so as to rotate therewith. The bottom of carrier plates 46 has two concave support wheels 68 rotatably positioned thereon. A horizontally positioned support rail 66 contacts the bottom portion of support wheels 68 thus supporting carrier plate 46.

Figure 5:
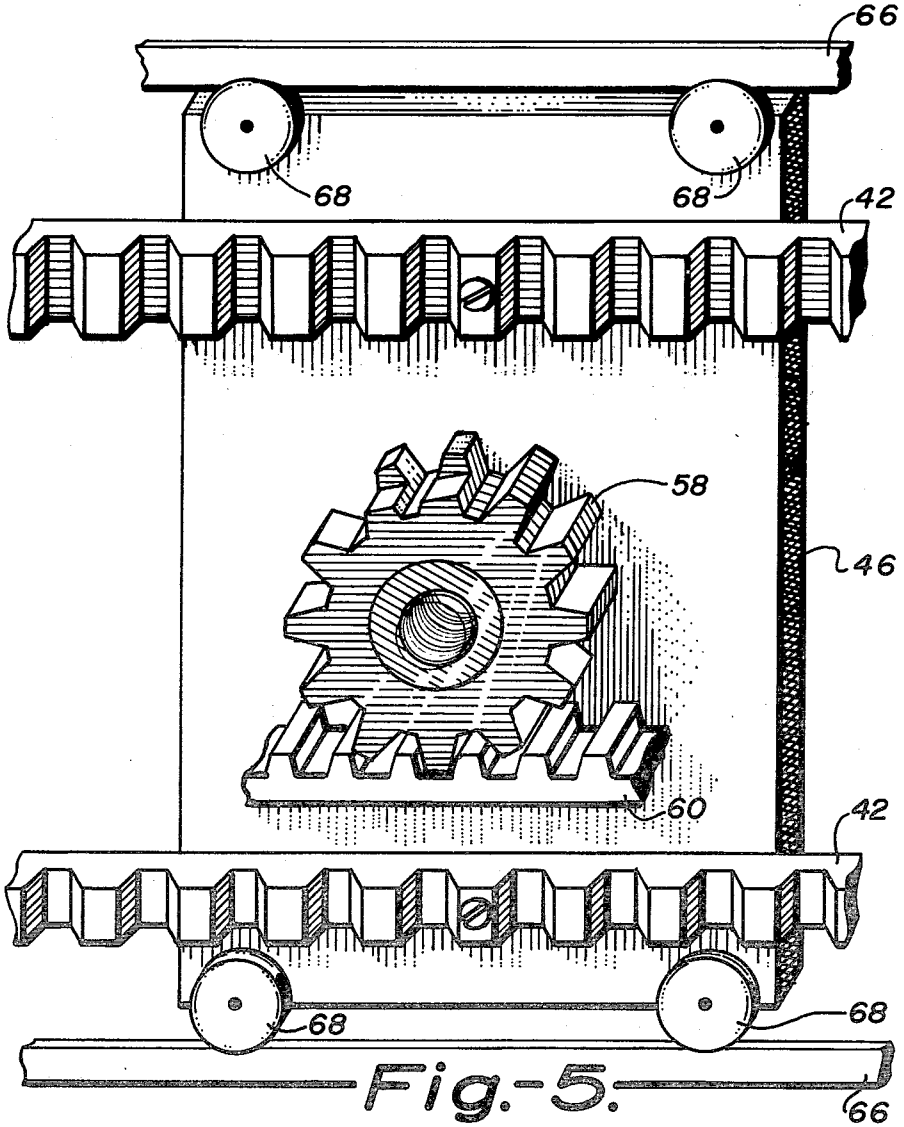
FIG. 5, is a plan view of the rear of the mandrel of FIG. 4, showing a mandrel gear thereon.
Figure 4:
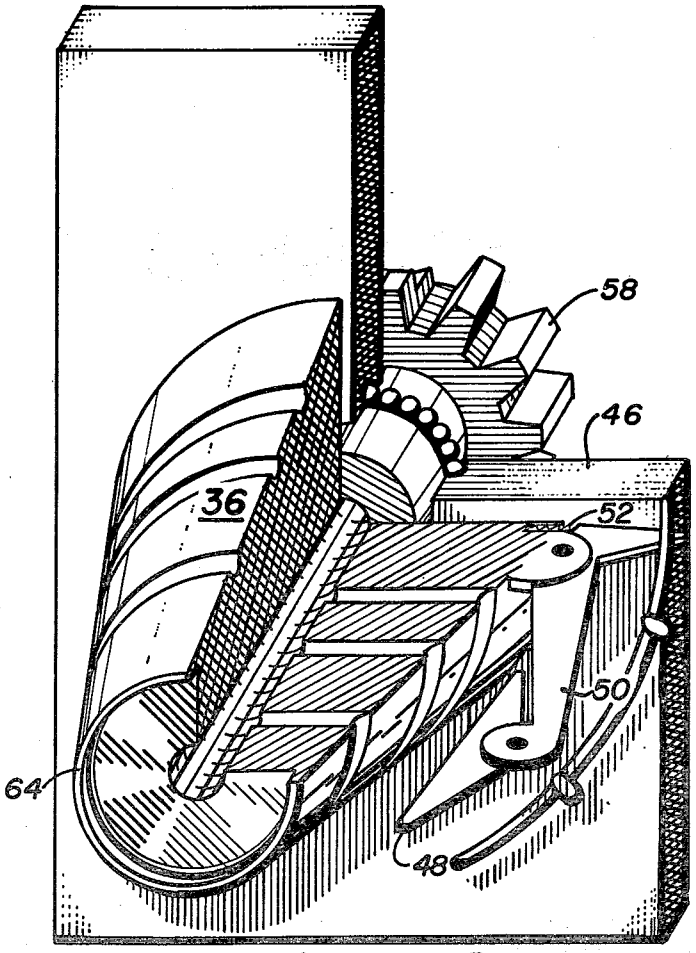
FIG. 4, is a plan view of a mandrel of FIG. 3, partially in section.

A cone-shaped mandrel 36 is attached to each carrier plate 46 and extends perpendicularly and outwardly therefrom. Referring now to FIGS. 4 and 5, mandrel 36 has three circular vacuum ribs 64 on the surface thereof, each connected with a vacuum system (not shown) axially positioned within mandrel 36. The rear portion of carrier plate 46 has a mandrel gear 58 mounted thereon which is connected to mandrel 36, whereby the rotation of mandrel gear 58 will rotate mandrel 36. A mandrel gear rack 60 is positioned at the central section of rotary conveyor system 40 and adapted to engage mandrel gear 58 so as to rotate it. On the lateral portion of mandrel 36 is positioned a pivotable clamp arm 50 pivotally attached to a paper clamp 48. Clamp arm spring 52 biases clamp arm 50 so as to force paper clamp 48 against the lateral portion of mandrel 36. A semi-circular clamp lifting device 62 is attached to the forward portion of carrier plate 46 so as to engage the end portion of clamp arm 50 on each rotation of mandrel 36. Thus, when the end portion of clamp arm 50 contacts clamp lifting device 62, clamp arm 50 pivots against the bias of clamp arm spring 52 so as to force paper clamp 48 off the lateral portion of mandrel 36. A paper lifting bar 54 is mounted in the center portion of rotary conveyor system 40 so as to contact the end portion of clamp arm 50 against the bias of clamp arm spring 52 causing paper clamp 48 to move away from the lateral portion of mandrel 36.

A paper blank delivery system 70 is positioned in the central portion of rotary conveyor system 40 and adapted to deliver individual sidewall paper blanks to mandrel 36 in this position. The paper blanks 56 are pre-gummed and adhesived on the bottom and lateral portion thereof.

In operation, timing pulleys 44 are power driven to rotate timing belts 42, carrier plates 46 and attached mandrels 36 in the fashion of an endless belt. Rotating die drum device 10 is power driven to rotate in a clockwise direction and is positioned directly opposite station I of the rotary conveyor system 40. The speed of rotation of conveyor system 40 is matched to that of die drum device 10 so that forming tool 30 and mandrel 36 rotate opposite one another and at the same speed. The positioning of mandrel 36 and forming tool 30 is such that when the forming tool 30 comes opposite station I, a mandrel 36 is positioned directly opposite it and traveling at the same speed.

As die drum 10 rotates, and forming tool 30 comes opposite paper stock 18, positioned between inner wall 14 and outer wall 16, forming tool 30 is activated by a camming system (not shown) to move toward outer wall 16. Parting tool 26 engages parting groove 28 to cut off a portion of paper stock 18. At the same time, male punch 22 engages circular female die groove 24 to punch a circular bottom disc 34 of paper stock 18 which is held in place by parting tool 26 and male punch 22. As forming tool 30 moves toward station I, forming tool 30, activated by a camming device (not shown) presses against bottom disc 34 to form sidewalls thereon. When forming tool 30 reaches station I it is directly opposite and traveling at the same speed as mandrel 36. At this point, transfer tool 32, activated by a camming system (not shown), presses bottom disc 34 into the end portion of mandrel 36 and withdraws. Mandrel 36 with bottom disc 34 travels toward station II, at which point the end portion of clamp arm 50 strikes lifting bar 54 causing clamp arm 50 to move away from the side of mandrel 36. Paper blank delivery system 70 then delivers a sidewall paper blank to the bottom portion of rotating mandrel 36. This blank has been pre-gummed or pre-adhesived along the bottom and lateral portion thereof. When the edge of paper blank 56 is directly under paper clamp 48, paper clamp 48 is released by lifting bar 54 and the edge of paper blank 56 clamped to rotating mandrel 36. As mandrel 36 rotates, it rolls paper blank 56 therearound. When paper blank 56 has been wrapped completely around mandrel 36 a vacuum is applied to vacuum system (not shown) and hence to connecting vacuum ribs 64 to force paper blank 56 in intimate contact with mandrel 36. At this point, the end portion of clamp arm 50 strikes clamp lifting device 62, causing paper clamp 48 to release paper blank 56 momentarily. Clamp arm 50 then rotates free of clamp lifting device 62 and paper clamp 48 biased by clamp arm spring 52 presses paper blank 56 to its adhesived edge to cause paper blank 56 to be attached in the form of a container. At the same time, bottom disc 34 is pressed against the bottom portion of a paper blank 56, also adhesived, and forms the permanent bottom of a paper container. The mandrel, containing the paper container then rotates from station III where the completed paper container is removed (not shown). Thus as may be seen, the paper container is formed by a continuous non-stop process.

I claim:

1. A constant flow paper cup making machine, comprising in combination:

a rotating die drum device;

a plurality of paper punching devices radially positioned upon said die drum device;

a rotating conveyor system;

a plurality of mandrels synchronized to move at the same speed and opposite said rotating paper punching device;

a paper delivering system, driven with said die drum device;

means whereby a circular bottom disc is punched from said paper delivery system;

transferring means to transfer said circular bottom disc from said paper punching device to said mandrels;

a container sidewall delivery system adapted to deliver pre-gummed paper blanks to said mandrel;

clamping means adapted to clamp said paper blanks to said mandrel;

mandrel rotating means adapted to rotate said mandrel, wrapping said paper blanks therearound;

clamping means adapted to clamp said paper blanks upon said mandrel;

ejecting means adapted to eject a completed paper cup from said mandrel.

2. The combination as claimed in claim 1, in which said paper punching device is comprised of, in combination:

a cylindrically shaped paper punch;

a cylindrically shaped forming tool concentrically positioned within said paper punch a cylindrically shaped transferring tool concentrically positioned within said forming tool, said paper punch, said forming tool and said transferring tool adapted for axial movement.

3. The combination as claimed in claim 2, in which said die drum device is comprised of, in combination:

a cylindrically shaped outer wall;

a cylindrically shaped inner wall concentrically positioned within said outer wall;

paper stock positioned between said inner wall and said outer wall;

means for rotating said die drum device.

4. The combination as claimed in claim 3, in which said rotating conveyor system is comprised of, in combination:

rotating timing pulleys;

timing belts positioned between said rotating timing pulleys;

carrier plates integrally attached to said timing belts;

cone-shaped mandrels rotatably attached to said carrier plates;

a paper blank delivery system positioned adjacent to said mandrel and adapted to deliver pre-gummed paper blanks to said mandrel.

5. The combination as claimed in claim 4, in which said mandrel is comprised of, in combination:

a cone-shaped element rotatably attached to said carrier plate;

a circular disc receiving element positioned on the end portion of said cone-shaped element;

a plurality of vacuum ribs about said cone-shaped element;

vacuum means in communication with said vacuum ribs;

a mandrel gear, integrally attached to the bottom portion of said cone-shaped element;

a paper clamping device pivotally attached to said mandrel and adapted to clamp paper blanks thereto;

a clamp lifting device integrally attached to said carrier plate adapted to engage said paper clamp on the rotation of said mandrel and raise said paper clamp from said mandrel.

6. The combination as claimed in claim 5, in which a clamp lifting device positioned adjacent to said mandrel is adapted to engage said paper clamp, upon the rotation of said mandrel, and open said paper clamp;

a mandrel gear rack positioned adjacent to said carrier plate and adapted to engage said mandrel gear and to rotate said mandrel.

7. The combination as claimed in claim 6, in which a support wheel rotatably attached to said carrier plate;

a support rail adapted to engage said support wheel, said support rail stationarily positioned relative to said rotary conveyor system.

* * * * *